United States Patent [19]

Kirkham

[11] Patent Number: 4,966,288

[45] Date of Patent: Oct. 30, 1990

[54] VALVE TRAIN ORGANIZER

[76] Inventor: Paul W. Kirkham, 16550 Madison St., NE., Ham Lake, Minn. 55304

[21] Appl. No.: 234,934

[22] Filed: Aug. 22, 1988

[51] Int. Cl.[5] ..... A47F 7/00

[52] U.S. Cl. ..... 211/60.1; 211/13

[58] Field of Search ..... 211/60.1, 59.1, 74, 211/70.1, 13, 70.6

[56] References Cited

U.S. PATENT DOCUMENTS

| | | | |
|---|---|---|---|
| 1,864,305 | 6/1932 | Holmes . | |
| 1,907,435 | 5/1933 | Murphy . | |
| 2,293,098 | 8/1942 | Baer | 211/69 |
| 2,312,434 | 3/1943 | Nathan | 211/60.1 |
| 2,457,197 | 12/1948 | Beckmann . | |
| 2,548,289 | 1/1950 | Carraher . | |
| 2,704,256 | 3/1955 | Rose . | |
| 3,062,380 | 11/1962 | Gvela et al. | 211/73 |
| 3,351,210 | 11/1967 | Murcott . | |
| 3,807,954 | 4/1974 | McDonald . | |
| 4,284,603 | 8/1981 | Korom | 211/74 X |
| 4,364,243 | 12/1982 | Deyesso . | |
| 4,380,293 | 4/1983 | Wilcox . | |

OTHER PUBLICATIONS

Advertisement, Hot Rod Magazine, Apr. 1988, vol. 41, No. 4, p. 152—P-Ayr Products.

*Primary Examiner*—Robert W. Gibson, Jr.
*Attorney, Agent, or Firm*—Sten Erik Hakanson

[57] ABSTRACT

The present invention comprises a device for holding and organizing the major valve train components of an internal combustion engine during disassembly thereof. The organizing device includes a collapsible valve suspending rack, a valve train component organizing portion and a residue tray. The valve rack includes a suspending portion having a plurality of holes for providing for the suspension of engine valves therefrom. The organizing portion includes parallel rows of flat support portions having valve spring holding pins, and push rod and lifter retaining holes. The residue tray provides for holding the rack and organizing portion, and for retaining any oil or other liquids that may drain from the engine components.

38 Claims, 3 Drawing Sheets

VALVE TRAIN ORGANIZER

BACKGROUND OF THE INVENTION

1. Field of the Invention

The present invention relates generally to devices used to hold and separate various components of an internal combustion engine during disassembly and repair thereof, and specifically to such devices that are designed to hold and separate individually the major components of the valve train of the engine.

2. Background

A variety of devices have been proposed that provide for separating and holding of engine parts during disassembly or overhaul of an engine. This organization allows the various subgroups of components, such as intake valves and exhaust valves to be easily put back into their original position in the engine upon re-assembly thereof. This conservative reconstruction is desirable due to the unique manner in which such engine components will wear during engine operation. Thus, for example, the valves will have worn in a particular fashion in conjunction with their respective valve seat so that optimum valve-seat sealing requires that the original order there between be maintained. Also, if a problem is found with a part the mechanic can then quickly check the other components it was associated with to see if such other parts are in any way defective.

Specifically, the prior art generally consists of rack or tray structures having a plurality of slots or holes for holding particular parts. These prior devices focus primarily on providing for organizing of the valves. See for example, U.S. Pat. Nos. 2,548,289 to Carraher, and 1,864,305 to Holmes. However, it is also of valve to allow for the ordering of other valve train components, such as, the lifters, push rods and valve springs.

Moreover, it is often desirable to clean or rinse such engine parts prior to assembly, typically by use of a solvent bath. Thus, it would be highly desirable to have an organizing device that is capable of holding such parts in a compact manner so that they can be efficiently used with, and easily placed into, a solvent bath. In addition, it would be very advantageous for such an organizing device to allow for the draining away and collecting of the cleaning solvents and of any residual oils, and to be easily stored when not in use.

SUMMARY OF THE INVENTION

The objects and advantages of the present invention include, but are not limited to, the following:

1. To provide for the compact holding and organizing of the major valve train components of an internal combustion engine.

2. To prevent loss or damage of such components and for allowing the easy cleaning thereof.

3. To provide for the catching and retaining of residual oils or solvents that may drain from the valve train components.

4. To provide for a valve train organizing device that is convenient and easy to use, and is easily stored when not needed.

The present invention is a device for holding and organizing the valve train related components of an internal combustion engine during disassembly and repair thereof. The valve train organizer herein includes three major separate components, a collapsible valve rack, an interior support portion and a residue collecting tray.

The valve rack includes a rectangular valve suspending platform having a plurality of valve holes therein. The holes run in two parallel rows, each row extending along the length thereof adjacent the outer edge. An elongate rectangular opening also extends along the length thereof between the valve holes. A pair of support legs are pivotally secured to the ends of the platform.

The interior support portion includes a pair of bottom outer levels having a plurality of upright extending regularly spaced valve spring retaining pins. The support portion also includes a pair of middle levels spaced above and inwardly of the bottom levels, and includes a plurality of regularly spaced lower push rod support holes. Additionally, the support portion includes a pair of top flanges overhanging each middle level. The flanges include a plurality of regularly spaced and alternating upper push rod support holes and lifter retaining holes. The upper push rod supporting holes are located above the lower support holes and slightly inwardly thereof. The lifter retaining holes are located above the space existing between the lower push rod support holes of the middle level.

The residue retaining tray is essentially flat, having a shallow perimeter edge, and is sized to lie below and cradle or hold the valve support rack and the interior support portion.

In use, it can be understood that the valve stem portion of an engine's valves can extend downwardly through the valve holes in the valve rack, and, as the holes are sized smaller than the valve end, the valves will be suspended therefrom. Also, the support legs are collapsible by swinging inwardly towards the rack platform to allow for easy storage thereof when not in use.

The valve springs and valve caps can be held and organized on the lower level of the interior parts support portion by the spring pins extending upwardly therefrom and through the center of the springs and caps. The push rods are held and organized by extension through the upper and lower push rod holes and by one of the ends thereof resting on the residue tray. The offsetting of these holes causes the push rods to lean slightly, thereby allowing the rods to more securely maintain their particular orientation, as opposed to the greater incidental movement that would be encountered if the rods extended substantially vertically. Also, the rectangular opening in the valve rack allows the push rods to extend and be easily accessed there through when the valve rack is in position over the interior support portion. The valve lifters are placed through the lifter retaining holes in the upper flanges and rest on the middle level on the spaces thereof between the lower push rod holes. The height difference between the upper flanges and the middle level is sized somewhat less than the height of a typical lifter so that the top thereof will be held by the lifter retaining holes.

It can be appreciated that the residue tray underlying the valve rack and the support portion serves to catch and retain any oil or solvent residue that drains from the parts.

The present invention therefore provides for clean, secure and compact retaining and organizing of the valve train components of an internal combustion engine. In particular, as the three portions of the present invention are not secured together, it can be understood that the valve rack provides for a convenient way of carrying only the valves, for example, to a valve grinding location.

DESCRIPTION OF THE DRAWINGS

Further objects and advantages of the present invention can be understood in light of the following detailed description which refers to the following figures wherein.

DETAILED DESCRIPTION OF THE PREFERRED EMBODIMENT

Figure 1:
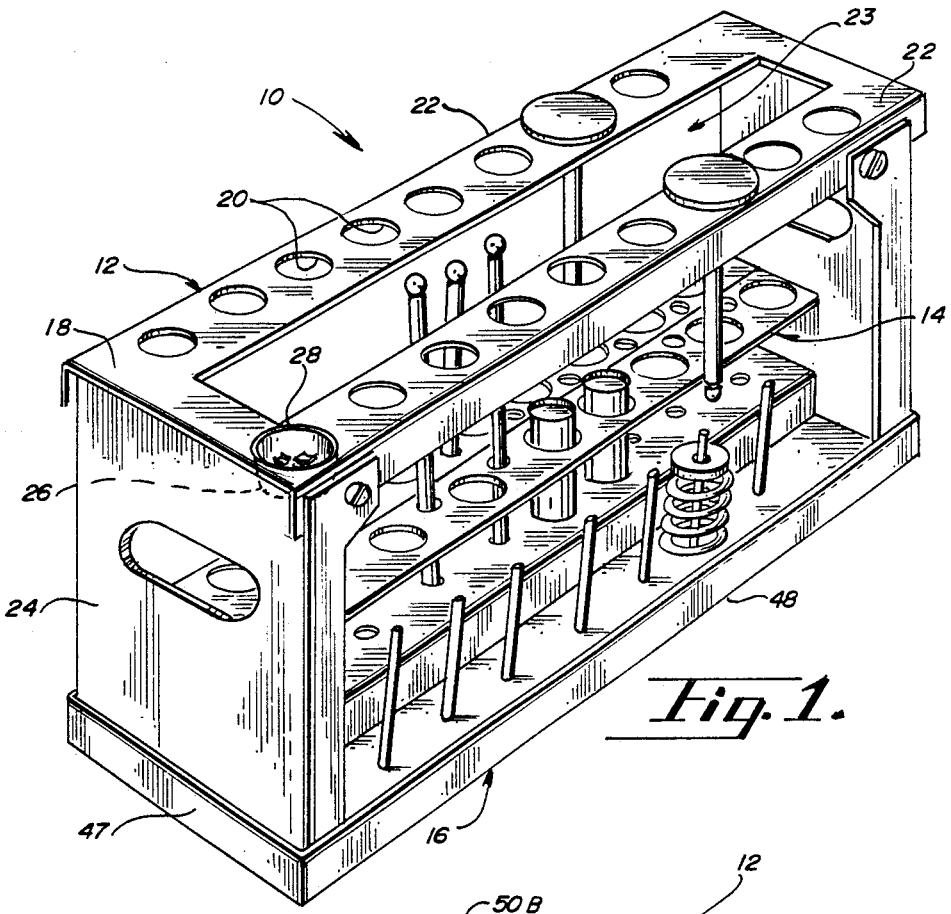
FIG. 1 is a perspective view of the present invention.

Referring to FIG. 1, the valve train organizer of the present invention is referred to generally by the numeral 10. Organizer 10 consists of three primary interrelating yet separate sections, a collapsible valve rack 12, an interior valve train component organizing portion 14, and a residue drain tray 16.

Figure 2:
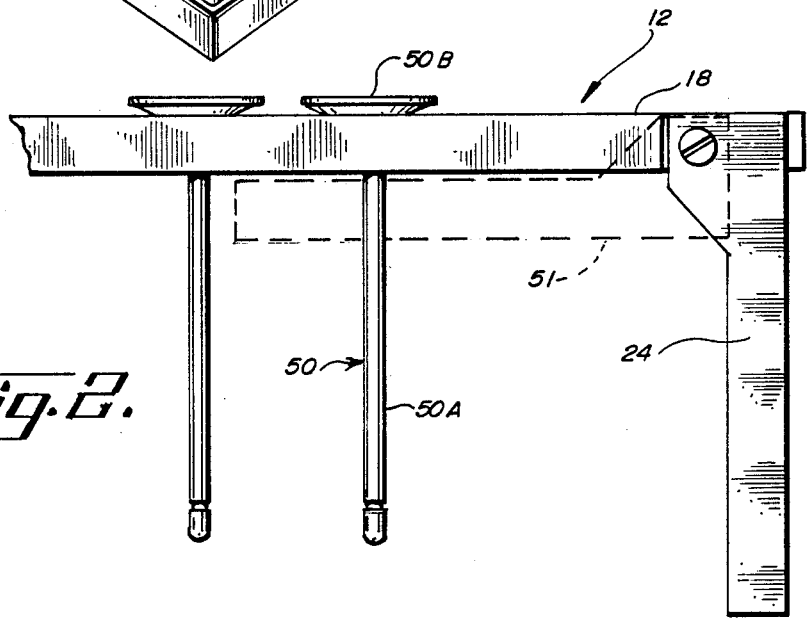
FIG. 2 is a side plan view of the valve rack support portion of the present invention.
Figure 3:
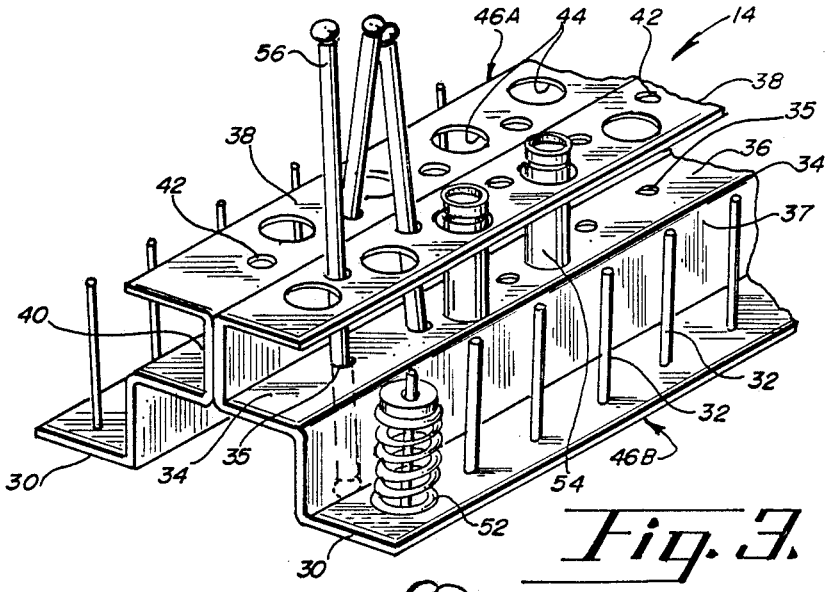
FIG. 3 is a perspective view of the interior parts support portion of the present invention.
Figure 4:
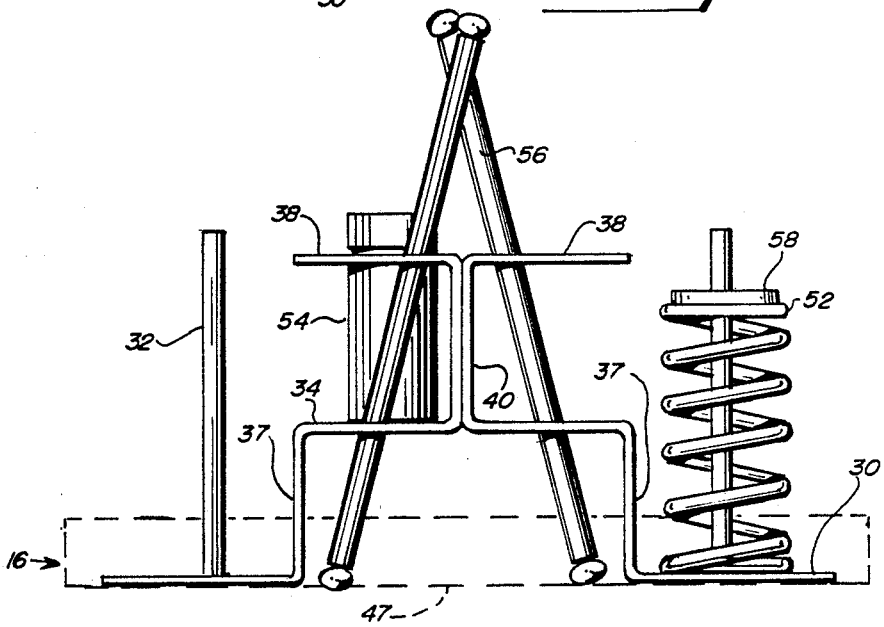
FIG. 4 is an end plan view of the interior parts support portion.

As seen by also referring to FIG. 2, valve rack 12 includes a rectangular and planar valve suspending portion 18 having two rows of valve suspending holes 20 extending along the length and adjacent the perimeter edges 22 thereof. An elongate opening 23 extends along the length of portion 18 between holes 20. A pair of valve tray support legs 24 are pivotally secured to each end of tray 18. A valve retaining clip cup 26 is releasably engaged with portion 18. Cup 26 extends through a hole, not shown, in tray 18 and is held therein by annular lip 28 of cup 26.

As seen by also referring to FIG.'s 3 and 4, interior portion 14 includes a pair of elongate bottom level sections 30. Bottom levels 30 have a plurality of valve spring pins 32. Pins 32 extend at regular intervals along the length of levels 30 and are secured to or integral thereto and extend upwardly therefrom. Organizing portion 14 also includes a pair of middle level sections 34 having a plurality of alternating and regularly spaced lower push-rod holes 35 and lifter support areas 36. Middle levels 34 are spaced above bottom levels 30 and are integral or connected therewith by riser sections 37. Furthermore, organizing portion 14 includes a pair of overhanging flanges 38. Flanges 38 are integral with or connected to middle levels 34 by a pair of riser portions 40. Flanges 38 include a plurality of regularity spaced and alternating upper push-rod holes 42 and lifter retaining holes 44. Upper push-rod holes 42 lie directly above and slightly inwardly of the corresponding lower push-rod holes 35, and lifter retaining holes 44 are held above middle level support areas 36 that exist between lower push-rod holes 35. In the disclosed embodiment, portion 14 consists of two separate sheet metal units 46A and 46B joined together along risers 40. However, portion 14 could be formed as one integral unit as may be dictated by manufacturing considerations.

Residue tray 16 is has a flat bottom surface 47 having an upturned perimeter edge 48.

In use, the present invention conveniently and compactly stores the major components of an internal combustion engine valve train including the valves, lifters valve springs and the push rods. As seen by referring to the various figures, rack 12 provides for holding and organizing of valves 50 by suspension thereof in an inverted manner through holes 20 whereby the stem portion 50A are inserted through holes 20 which are sized smaller than valve ends 50B. Also, cup 26 can provide for holding of a variety of small parts, such as valve keepers. As indicated by dashed line 51, legs 24 are both swingable upwardly against portion 18 to allow for collapsing of rack 12 to a smaller size when not in use.

Organizing portion 14 provides for the orderly retaining of valve springs 52, lifters 54 and push rods 56. As seen in FIG.'s 3 and 4, push rods 56 are inserted through retaining holes 35 and 42 down to surface 47 of residue tray 16. The offsetting of these holes causes an angular stance which permits the push rods 56 to be held more firmly in portion 14, and the two point contact also serves to retain push rods 56 securely by limiting the possible range of movement thereof. Valve springs 52 are placed over pins 32 and retained thereon. Also, the associated spring caps 58 can be placed on the top of springs 52 with pin 32 extending through the center thereof. Lifters 54 are inserted through holes 44 and rest on support areas 36 of middle level 34 beneath holes 44, and in between lower push rod holes 35. The height of riser 40 is sized to be less than that of a lifter so that hole 44 allows for retaining of the lifter by restricting lateral movement thereof. It can be appreciated that elimination of flanges 38 would result in a functional device wherein holes 35 would serve to hold push rods 56, and lifters 54 could rest upon support surface 47.

Residue tray 16 provides for the holding of any oil or solvent that may run off the various engine components. Also, tray 16 serves as a means for releasably holding rack 12 and portion 14 in the relationship as seen in FIG. 1, so that all three major components can be held and carried together in a compact manner. As shown in the various figures, valve spring pins 32 of bottom sections 30 lie outwardly of flanges 38 and middle support levels 34. As a result thereof, rack 12 can be sized to fit over portion 14, whereby rectangular slot 23 provides for the extension there through of push rods 56 so as to minimize the height of legs 18. Also, holes 20 extend through suspending portion 18 adjacent edges 22 as the valve stems 53 will then not interfere with the valve springs held on bottom level 30. Therefore, the present invention provides for the holding of the various valve train components in a space efficient manner.

Figure 5:
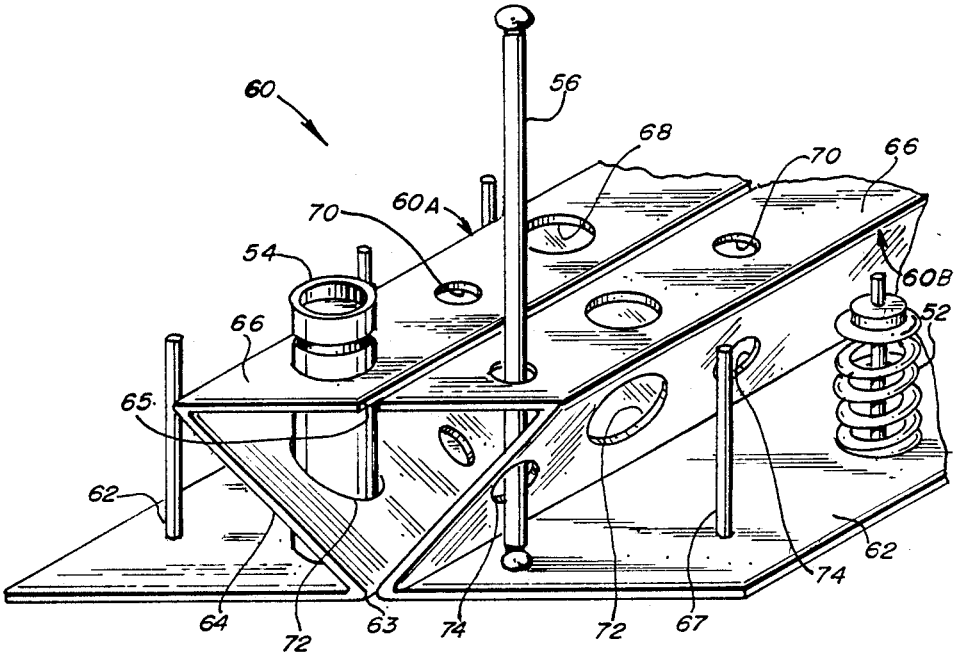
FIG. 5 is a perspective view of an alternative embodiment of the internal organizing portion.

An alternative embodiment of interior portion 14 is seen in FIG. 5, and generally referred to by numeral 60. Portion 60 is sized similarly to that of portion 14, and consists primarily of two halves 60A and 60B. Halves 60A and 60B can each be described as an integral z-shaped unit having an elongated planar bottom level 62, an elongate planar middle angled level 64, and an elongate planar top level 66. An elongate edge of bottom level 62 is integral with the lower elongate edge of angled level 64 forming a common edge 63. An elongate edge of top level 66 is integral with the upper elongate edge of angled level 64 forming a common edge 65. Bottom levels 62 have a plurality of spring retaining pins 68 secured to, and extending upwardly therefrom. Top level 66 has a plurality of alternating and regularly spaced upper lifter retaining holes 68, and upper push rod retaining holes 70. Middle levels 64 include a plurality of alternating and regularly spaced intermediate lifter retaining holes 72 and push rod retaining holes 74 located thereon directly below the corresponding or cooperating holes 68 and 70 respectively of top level 66. Halves 60A and 60B can each be formed from a single piece of sheet metal or other suitable material.

In use, as with portion 14, portion 60 retains a plurality of push rods 56, valve springs 52 and lifters 54. Push rods 56 extend through retaining holes 70 and 74 and rest upon bottom levels 62. In a similar manner, lifters 54 extend through retaining holes 68 and 72 and rest upon bottom level 62. Valve springs extend over and are retained by pins 62 in the same manner as previously described with pins 38 of portion 14. It can be appreciated that the two levels 64 and 66 provide for two points at which movement of lifters 66 and push rods 56 is restricted. These two points of restriction are more important for the thin push rods 56, however, it can be understood that a functional device could be had with only two levels. For example, levels 66 could be eliminated and retention of push rods 56, springs 52 and lifters 54 could be accomplished. Portion 60 cooperates in the same manner as portion 14 with support 12 and residue tray 16 to form a compact valve train organizing device.

It can now be appreciated that the present invention provides a compact and convenient device for holding the valve train components of an internal combustion engine. Specifically, the present invention utilizes parallel rows of holes of various sizes, and pins for easily and quickly retaining such components, and for organizing such parts in a manner analogous to their orientation and interrelationship in the engine. It can be seen that the disclosed embodiment is designed for the disassembly of a conventional two valve per cylinder engine having up to eight cylinders. It is also apparent that organizer 10 is symmetrical and can be viewed as having a right and left half for corresponding with the right and left banks of a V-8 engine. Differentiation between right and left banks can be had by, for example, simply marking rack 12 and organizing portion 14 with a front and back indication, or, as with the disclosed embodiment, with the holes and pins of one half being advanced somewhat and in opposite sequence of the holes and pins of the half across therefrom. It can also be readily understood that the present invention can be used with conventional four and six cylinder engines. Where, for example, the present invention could be extended in length or where only one half thereof need be utilized. Moreover, it will be apparent to those of skill in the art that the invention herein need not include a first half having a second or mirror image half thereto. Thus, for example, portions 14 and 60 could consist of only unit 46A, or 60B respectively, and suspending rack 12 could be manufactured to conform therewith and include only a single row of holes 20. In addition, it will be apparent to those of skill in the art, that the structure of the invention could be extended to provide for disassembly of an engine having any number of cylinders, thus more valve train components. It will also be apparent that, in the case where an engine has, for example, four valves per cylinder, additional parallel rows of valve suspending holes 20, push rod retaining holes 35 and 42, spring retaining pins 32 and lifter retaining holes 44, could be added to organizer 10, along with any needed proportional increase in the width of rack 12, organizing portion 14 and residue tray 16 to provide for the retaining of the added valves and their related components.

It will be understood by those of skill, that a variety of modifications can be made to the present invention without exceeding the spirit and scope thereof. Basically, the present invention herein consists of a separate valve suspending rack and interior valve train component portion having parallel and/or coordinated levels of regularly spaced attachment or securing means for releasably suspending or retaining internal combustion engine valves and related valve train components in a compact and organized fashion. It is therefore clear that a wide variety of securing and suspending means could be utilized to retain the various valves and valve train components. Thus, for example, pins 32 could be replaced with circular depressions or indentations in bottom level 30 into which the valve springs could be placed or nestled. Likewise holes 35 and 42 could be replaced with a variety of clip means attached, for example, to riser 40 for holding the push rods in an upright manner. It can also be understood that the height at which a group or class of components is held with respect to the other components is not particularly crucial. However, it is generally preferred that the lifters, especially hydraulic ones, be held above the other valve train parts. In this manner, the other parts can be cleaned in a solvent bath without resulting in the submerging of the lifters, as such immersing of the lifters can be detrimental to them.

What is claimed is:

1. A valve train component holding and organizing device, comprising, a. a valve rack, the rack having a valve support portion, the support portion including a plurality of regularly spaced valve retaining means;

b. an interior portion, the interior portion having a first spring retaining level including a plurality of valve spring retaining means, and a second level secured to the first level and held at a height above the first level, and the second level secured to the first level wherein the second level does not overhang the first level, the second level having a plurality of alternating lifter retaining means and push rod retaining means extending there along; and c. means for releasably holding the interior portion and the valve rack together, and the valve rack being held below the valve suspending rack.

2. The organizing device as defined in claim 1, and the valve spring retaining means comprising pins secured to and extending upwardly from the first level.

3. The organizing device as defined in claim 1, and the push rod and lifter retaining means comprising alternating and regularly spaced holes extending along and through the second level.

4. The organizing device as defined in claim 1, and further including a third level, integral with the first and second levels, and the third level including a plurality of regularly spaced and alternating third level push rod and lifter retaining means extending along the third level in a manner corresponding to the second level push rod and lifter retaining means.

5. The organizing device as defined in claim 4, and the third level held above the second level.

6. The organizing device as defined in claim 5, and the third level retaining means comprising a plurality of alternating and regularly spaced third level push rod and lifter retaining holes.

7. The organizing device as defined in claim 3, and further including a third level, integral with the first and second levels, and the third level including a plurality of regularly spaced and alternating third level push rod and lifter retaining means extending along the third level in a manner corresponding to the second level push rod and lifter retaining means.

8. The organizing device as defined in claim 7, and the third level held above the second level.

9. The organizing device as defined in claim 8, and the third level retaining means comprising a plurality of alternating and regularly spaced third level push rod and lifter retaining holes.

10. The organizing device as defined in claim 1, and the means for releasably holding the valve rack and the interior portion comprising a residue tray.

11. The organizing device as defined in claim 1, and the valve rack having a pair of support legs pivotally secured to opposite ends thereof.

12. A valve train component holding and organizing device, comprising, a. a valve rack, the rack having an elongate suspension portion, the suspension portion including a plurality of valve suspending holes extending there through and regularly along the length thereof, b. an interior portion, the interior portion having a first half and a second half, each half having an elongate bottom level, and an elongate middle angled level having an upper and lower perimeter edge, the bottom level having a perimeter edge integral with the angled level lower edge, each bottom level having a plurality of valve spring retaining means extending along the length thereof, and each middle level having a plurality of intermediate regularly spaced and alternating lifter and push rod retaining means extending along the length thereof; and c. means for releasably holding the interior portion and the valve rack together, and the interior portion being held below the valve rack.

13. The organizing device as defined in claim 12, and the lifter and push rod retaining means comprising holes extending through and along the middle angled level.

14. The organizing device as described in claim 13, and each interior portion half further including a top level, the top level having a perimeter edge integral with the upper perimeter edge of the middle level and each top level having a plurality of upper alternating and regularly spaced lifter and push rod holes extending there through and along the length thereof in a manner cooperating with the lifter and push rod retaining holes of the middle level.

15. The organizing device as defined in claim 12, and the valve rack having a pair of support legs pivotally secured at opposite elongate ends thereof.

16. The organizing device as defined in claim 15, and the valve suspending holes extending along the length thereof in two parallel rows adjacent each elongate perimeter edge, and the valve suspending portion having an elongate rectangular opening extending through and along the area thereof between the parallel rows of valve suspending holes.

17. The organizing device as defined in claim 12, and the valve spring retaining means comprising spring retaining pins secured to the bottom levels and extending upwardly therefrom.

18. The organizing device as defined in claim 17, and the spring pins secured to the bottom level outwardly of the middle level.

19. The organizing device as defined in claim 13, and the spring pins secured to the bottom level outwardly of the middle level and of the top level.

20. A valve train component holding and organizing device, comprising:

a. a valve rack, the rack having an elongate suspension portion, the suspension portion including a plurality of valve suspending holes extending regularly along the length thereof;

b. an interior portion, the interior portion having a first half and a second half, each half having an elongate bottom level and an elongate middle level, the bottom level secured to the middle level along adjacent elongate edges by a first riser portion, and each bottom level having a plurality of valve spring retaining means extending along the length thereof, and each middle level having a plurality of alternating middle level push rod retaining means and lifter retaining means; and c. means for releasably holding the interior portion and the valve rack together, and the interior portion being held below the valve rack.

21. The organizing device as defined in claim 20, and the push rod retaining means comprising holes extending through and along the middle level and the lifter retaining means comprising lifter support areas between the middle level push rod holes.

22. The organizing device as described in claim 21, and each organizing portion half further including an elongate flange section, the flange secured along an elongate edge thereof to a second riser portion so that the flange overhangs the middle level, each flange having a plurality of upper alternating and regularly spaced lifter and push rod holes extending there through and along the length thereof in a manner cooperating with the push rod retaining holes and the lifter support areas of the middle level.

23. The organizing device as defined in claim 20, and the valve rack having a pair of support legs pivotally secured at opposite elongate ends thereof.

24. The organizing device as defined in claim 23, and the valve suspending holes extending along the length thereof in two parallel rows adjacent each elongate perimeter edge, and the valve suspending portion having an elongate rectangular opening extending along the area thereof between the parallel rows of valve suspending holes.

25. The organizing device as defined in claim 20, and the valve spring retaining means comprising spring retaining pins secured to the bottom levels and extending upwardly therefrom.

26. The organizing device as defined in claim 25, and the spring pins secured to the bottom level outwardly of the middle level.

27. The organizing device as defined in claim 22, and the spring pins secured to the bottom level outwardly of the middle level and of the top level.

28. A valve train component holding and organizing device, comprising:

a. a valve rack, the rack having a an elongate suspension portion, the suspension portion having a row of valve suspending holes extending regularly along an elongate edge thereof and having an elongate push rod hole extending there through along and centrally of the length of the elongate suspension portion;

b. an interior portion, the interior portion having an elongate bottom level and an elongate middle level, the middle level secured to the bottom level along common elongate edges thereof and held there above by a first riser portion, and the bottom level having a plurality of valve spring retaining means extending along the length thereof, and the middle level having a plurality of push rod retaining holes and lifter retaining spaces extending along the length thereof, and the interior portion further including an elongate flange, the flange secured along an elongate edge thereof to a second riser portion so that the flange overhangs the middle level, the flange having a plurality of upper alternating and regularly spaced lifter and push rod holes extending there through and along the length thereof in a manner cooperating with the lifter support spaces and the push rod retaining holes respectively of the middle level; and c. a drain tray for releasably holding the interior portion and the valve rack together, and the interior portion being held below the valve suspending rack.

29. The organizing device as defined in claim 28, and the valve rack having a pair of support legs pivotally secured at opposite ends of the suspension portion.

30. The organizing device as defined in claim 28, and the valve spring retaining means comprising spring retaining pins secured to the bottom levels and extending upwardly therefrom.

31. The organizing device as defined in claim 28, and the bottom level extending outwardly of the the middle level.

32. The organizing device as defined in claim 28, and the overhanging flange push rod holes and middle level pushrod holes are offset from each other to provide for an angled inclination of the pushrods when extending there through.

33. The organizing device as defined in claim 28, and the interior portion having symmetrical first and second halves.

34. A valve train component holding and organizing device, comprising:

a. a valve rack, the rack having a an elongate suspension portion, the suspension portion having a pair of parallel rows of valve suspending holes extending regularly along opposite elongate edges thereof and having an elongate push rod hole extending there through along the length of the elongate suspension portion between the parallel rows of valve suspending holes;

b. an interior portion, the interior portion having first and second symmetrical halves, each half having an elongate bottom level and an elongate middle level, each middle level secured to a corresponding bottom level along common elongate edges thereof and held there above by a first riser portion, and each bottom level having a plurality of valve spring retaining means extending along the length thereof outwardly of the middle level, and each middle level having a plurality of push rod retaining holes and lifter retaining spaces extending along the length thereof, and each interior portion further including an elongate flange, each flange secured along an elongate edge thereof to a second riser portion so that each flange overhangs each corresponding middle level, each flange having a plurality of upper alternating and regularly spaced lifter and push rod holes extending there through and along the length thereof in a manner cooperating with the lifter support spaces and the push rod retaining holes respectively of the middle level; and c. a drain tray for releasably holding the interior portion and the valve rack together, and the interior portion being held below the valve suspending rack.

35. The organizing device as defined in claim 34, and the valve rack having a pair of support legs pivotally secured at opposite ends of the suspension portion.

36. The organizing device as defined in claim 34, and the valve spring retaining means comprising spring retaining pins secured to the bottom levels and extending upwardly therefrom.

37. The organizing device as defined in claim 34, and the bottom level extending outwardly of the middle level.

38. The organizing device as defined in claim 34, and the overhanging flange push rod holes and middle level pushrod holes offset from each other to provide for an angled inclination of the pushrods when extending there through.

* * * * *